United States Patent [19]

Kato et al.

[11] 4,387,617

[45] Jun. 14, 1983

[54] ASSIGNER FOR ELECTRONIC MUSICAL INSTRUMENT

[75] Inventors: Hirokazu Kato; Akinori Endo, both of Hamamatsu, Japan

[73] Assignee: Nippon Gakki Seizo Kabushiki Kaisha, Shizuoka, Japan

[21] Appl. No.: 124,006

[22] Filed: Feb. 25, 1980

Related U.S. Application Data

[63] Continuation-in-part of Ser. No. 865,357, Dec. 28, 1977, abandoned.

[30] Foreign Application Priority Data

Dec. 29, 1976 [JP] Japan ..... 51-158950
Dec. 29, 1976 [JP] Japan ..... 51-158951

[51] Int. Cl.[3] ..... G10H 1/18; G10H 1/24; G10H 7/00

[52] U.S. Cl. ..... 84/1.01; 84/1.03; 84/1.19; 340/365 S

[58] Field of Search ..... 84/1.01, 1.03, 1.24–1.27, 84/1.11–1.13, 1.19, 1.21, 1.22; 340/365 R, 365 S

[56] References Cited

U.S. PATENT DOCUMENTS

| | | | |
|---|---|---|---|
| 3,875,842 | 4/1975 | Kmetz | 84/1.01 |
| 3,882,751 | 5/1975 | Tomisawa et al. | 84/1.01 |
| 3,899,951 | 8/1975 | Griffith et al. | 84/1.01 |
| 3,955,459 | 5/1976 | Mochida et al. | 84/1.01 |
| 3,981,217 | 9/1976 | Oya | 84/1.03 |
| 3,986,423 | 10/1976 | Rossum | 84/1.01 |
| 4,022,097 | 5/1977 | Strangio | 84/1.03 |
| 4,041,825 | 8/1977 | Pascetta | 84/1.01 |
| 4,041,826 | 8/1977 | Oya | 84/1.01 |
| 4,046,047 | 9/1977 | Roberts | 84/1.01 |
| 4,114,495 | 9/1978 | Tomisawa | 84/1.01 |
| 4,141,268 | 2/1979 | Kugisawa | 84/1.03 |
| 4,176,573 | 12/1979 | Deutsch | 84/1.01 |
| 4,202,234 | 5/1980 | Comerford | 84/1.01 |

*Primary Examiner*—Stanley J. Witkowski
*Attorney, Agent, or Firm*—Jordan and Hamburg

[57] ABSTRACT

An electronic musical instrument of a channel assignment type wherein depressed keys from among a larger plurality of keys are respectively assigned to a smaller plurality of tone producing channels for generating wave of musical tones. The assigner comprises a microprogram, an arithmetic section, a memory, and an interruption control circuit to assign the depressed keys to available tone producing channels. The current on-off information of the keys is subjected to calculation to form a key-on request file and a key-off request file. A tone request file is formed on a plurality of tone data as designated by the tone levers. A channel assignment table is formed, based on the key-on and key-off request files, to indicate a status of assigning the depressed keys to the tone producing channels. The channel assignment table is stored in the memory and the contents thereof are supplied to the wave generator, whereby a plurality of musical tones are generated simultaneously by the wave generator as controlled by the microprogram.

21 Claims, 14 Drawing Figures

ASSIGNER FOR ELECTRONIC MUSICAL INSTRUMENT

BACKGROUND OF THE INVENTION

This application is a continuation-in-part of co-pending application Ser. No. 865,357 filed Dec. 28, 1977, and now abandoned.

This invention relates to an assigner employed in an electronic musical instrument for assigning depressed keys to tone producing channels including wave generators for generating musical tones as designated by the depressed keys.

Recently, as the computer and the semiconductor techniques have been developed, a variety of digital type electronic musical instruments employing LSI (large scale integrated circuit) components have been developed and put in practical use. FIG. 1 is a block diagram illustrating a schematic arrangement of a conventional digital type electronic organ included in the above-described electronic musical instruments. As is apparent from FIG. 1, the conventional electronic organ comprises: a block (A) consisting of a keyboard switch circuit 1, a key coder 2, a channel assigner 3 and a frequency information memory 4, and a block (B) consisting of an envelope memory 5, a wave generator 6, and a digital-to-analog converter 7. The on-off information of a key switch in the keyboard switch circuit 1 is detected by the key coder 2, and frequency information corresponding to this on-off information is read out of the frequency information memory 4 whereas an envelope information for the detected key is read out of the envelope memory 5 as designated by the channel assigner 3, and both pieces of information are applied to a channel in the wave generator 6 which is selected by the channel assigner 3. The wave generator 6 carries out a predetermined arithmetic operation by receiving the frequency information and envelope information supplied by the envelope memory 5 to provide a digital musical tone signal, which is applied to the digital-to-analog (D/A) converter 7 where it is converted into an analog musical tone signal which is applied to a loudspeaker (not shown).

Thus, in the conventional electronic organ, the components 1 through 7 are made up of special logical circuits, respectively, and these special logical circuits are coupled to one another through wired logic.

Furthermore, in the conventional electronic organ, the block (A) is considerably different from the block (B) in function. More specifically, the main function of the block (A) is to assign predetermined data to the wave generator 6 according to the on-off information on each key in the keyboard 1 which is detected as the performer plays the organ. Therefore, in the block (A), the detection timing of the on-off information is the most important in time. On the other hand, the main function of the block (B) is to continuously and repeatedly at high speed carry out arithmetic operations at predetermined sampling time according to the data supplied from the block (A).

Thus, the above-described electronic organ is advantageous in that since its necessary components are coupled to one another through the wired logic, the number of elements constituting the electronic organ is, as a whole, relatively small, and as a result the electronic organ is compact and the cost thereof is low. However, the electronic organ is still disadvantageous in the following aspects: The aforementioned components themselves are intricate and are made up of special logical circuits. Therefore, when those components are manufactured as large scale integrated circuits, it is necessary to design a number of large scale integrated circuits which are extremely special and are less in general use, which leads to increase in cost. Furthermore, since the components are coupled through wired logic as described above, the spatial arrangement is complicated. Therefore, after the functions of the electronic organ are set up, it is considerably difficult to change the functions.

In addition, in the above-described electronic organ, although the operating rate of the block (A) is essentially different from that of the block (B), the block (A) is coupled through a wired logic to the block (B). Accordingly, it is necessary that the operation of the block (A) be in synchronization with that of the block (B), which makes the circuitry more intricate.

Furthermore, the conventional assigner is so designed that it operates to assign a plurality of musical tone generating systems (wave generators) according to only key information provided by the keyboard 1; that is, the assignment of the plurality of musical tone generating systems is not carried out according to both key information and tone color information. Therefore, it is impossible to generate a plurality of musical tones by depressing one key. If it is intended to generate a plurality of musical tones by operating one key, then it is necessary to provide more wave generators, and the arrangement necessarily becomes more intricate.

The key coder described above is made up of an address counter and an address decoder coupled to the keys of the keyboard 1, and logical circuits relating to them. In the key coder, the address counter is driven with a predetermined period in order to obtain the on-off information of keys from the logical circuit on the output side.

SUMMARY OF THE INVENTION

Accordingly, a primary object of this invention is to provide an assigner for an electronic musical instrument in which the block (A) of the above-described electronic organ for instance, that is, a conventional electronic musical instrument, is substantially separated from the block (B) thereof so that the blocks (A) and (B) can operate asynchronously with each other, and a plurality of tone color data are assigned to a plurality of channels and are simultaneously applied to wave generators with respect to one key output signal, whereby by the operation of one key in the keyboard a plurality of tones are simultaneously mixed and are produced by the wave generators.

Another object of this invention is to provide a novel keyboard key output detecting device which is different from a key coder employed in a conventional digital type electronic musical instrument such as for instance a conventional electronic organ.

The assigner for an electronic musical instrument according to the invention comprises a keyboard, a microprogram, an arithmetic section, a memory, and an interruption control circuit, in which assigner a key-on and key-off request file indicating the current on-off information on a key of the keyboard and a tone request file concerning a plurality of tone data requested for keys of the keyboard by means of a tone lever, or the like are formed, and by utilizing these files a channel assignment table is formed which indicates a status of assignment of a plurality of channels for producing a plurality of musical tones with respect to a keyboard's key being operated, the content of the channel assignment table being applied to wave generators so that a plurality of musical tones are produced by the wave generators simultaneously in response to the operation of one key in the keyboard.

In the assigner for an electronic musical instrument according to this invention, after the current keyboard status of keyboard's keys and the keyboard status one cycle earlier are determined, these two pieces of keyboard status are subjected to comparison to form the key-on request file and the key-off request file, whereby the above-described current on-off information on a key in the keyboard is obtained.

The manner in which the foregoing objects and other objects are achieved by this invention will become more apparent from the following detailed description and the appended claims when read in conjunction with the accompanying drawings.

Figure 1:
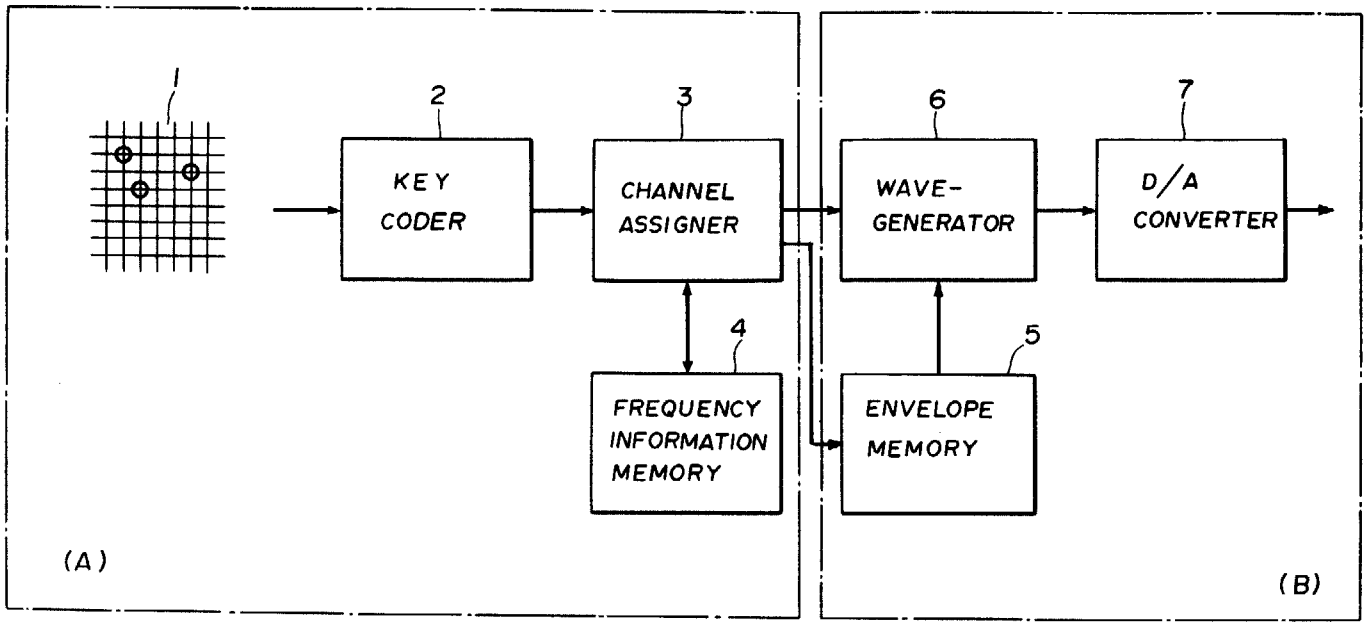
Fig. 1 PRIOR ART
FIG. 1 is a block diagram illustrating an arrangement of a conventional electronic organ.
Figure 2:
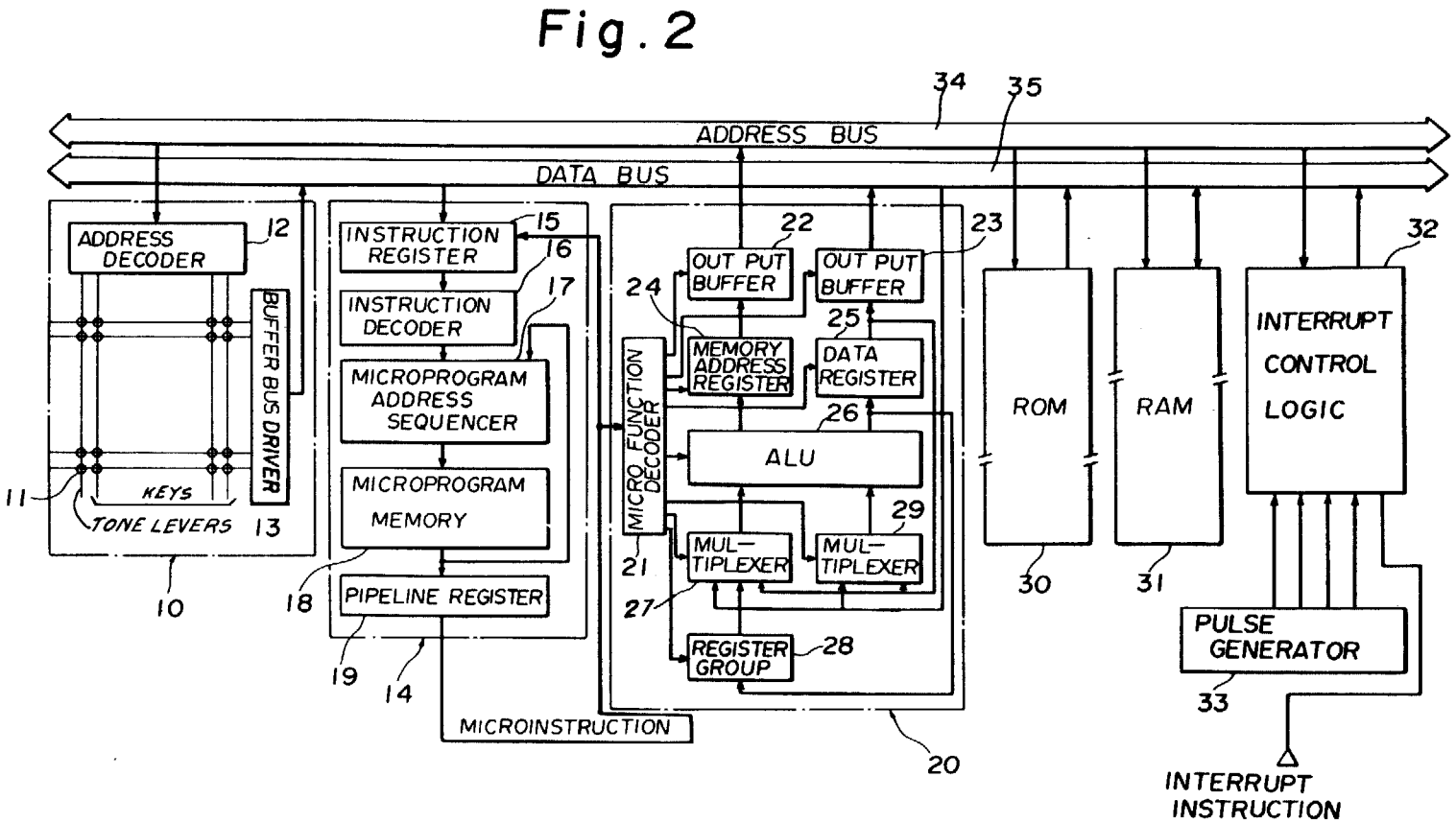
FIG. 2 through FIG. 14 show one example of an assigner for an electronic musical instrument according to this invention, applied to an electronic organ.
Figure 3:
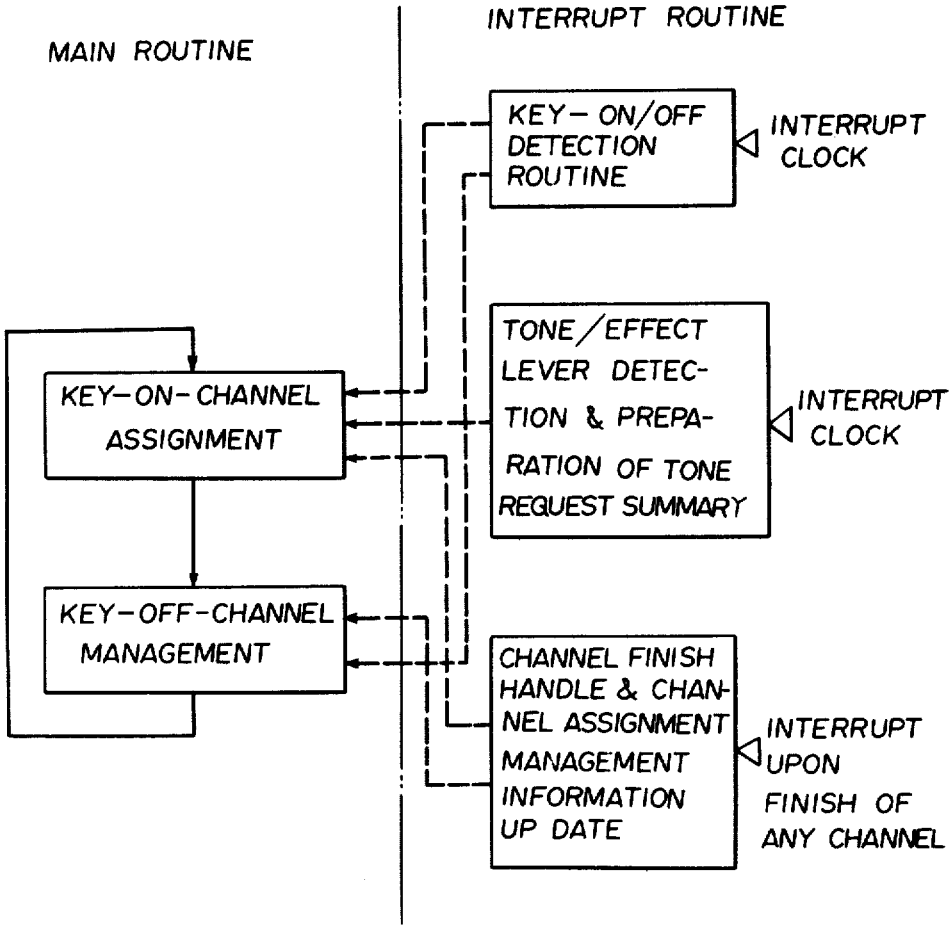
Figure 4:
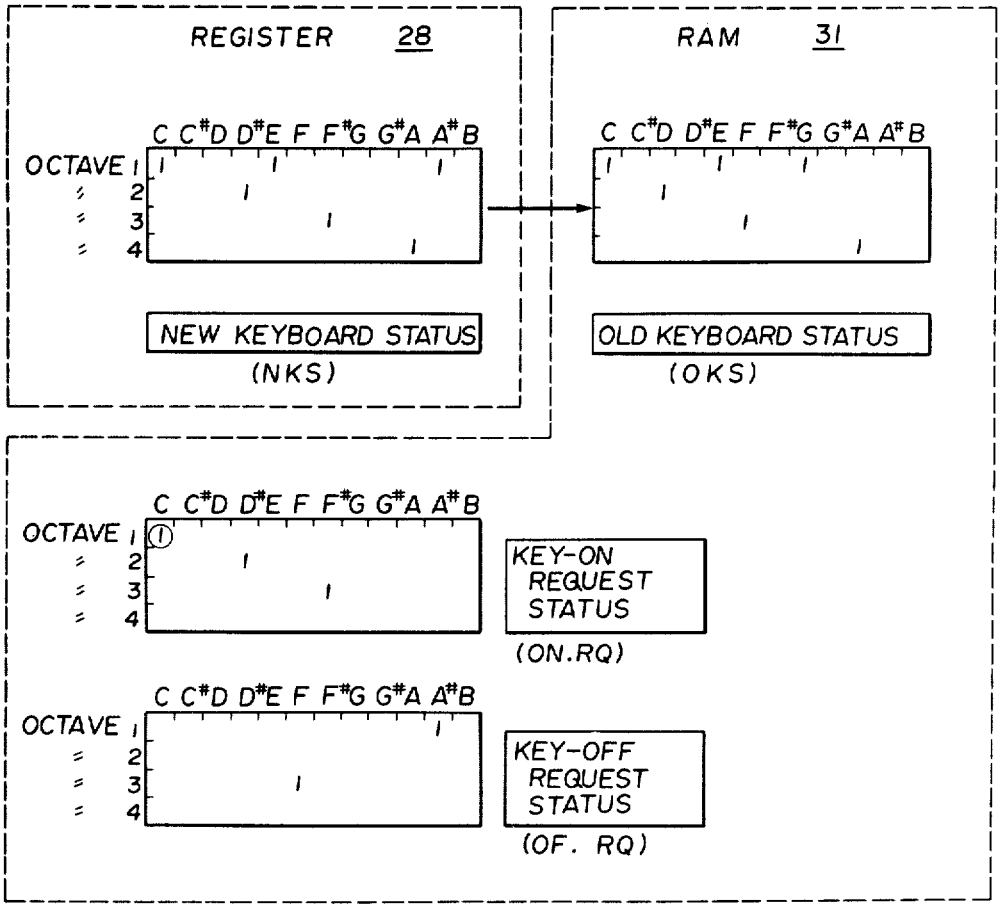
Figure 5:
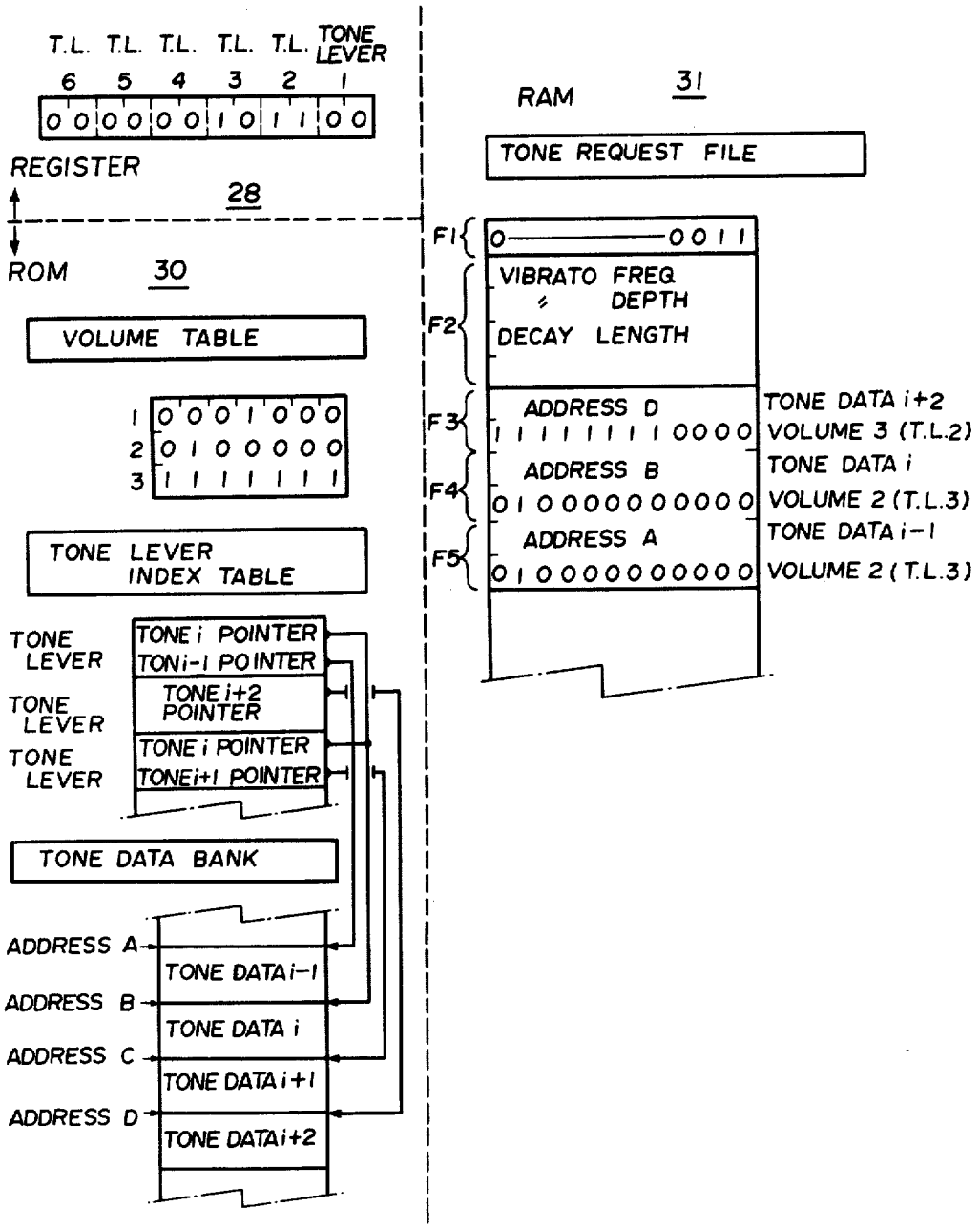
Figure 6:
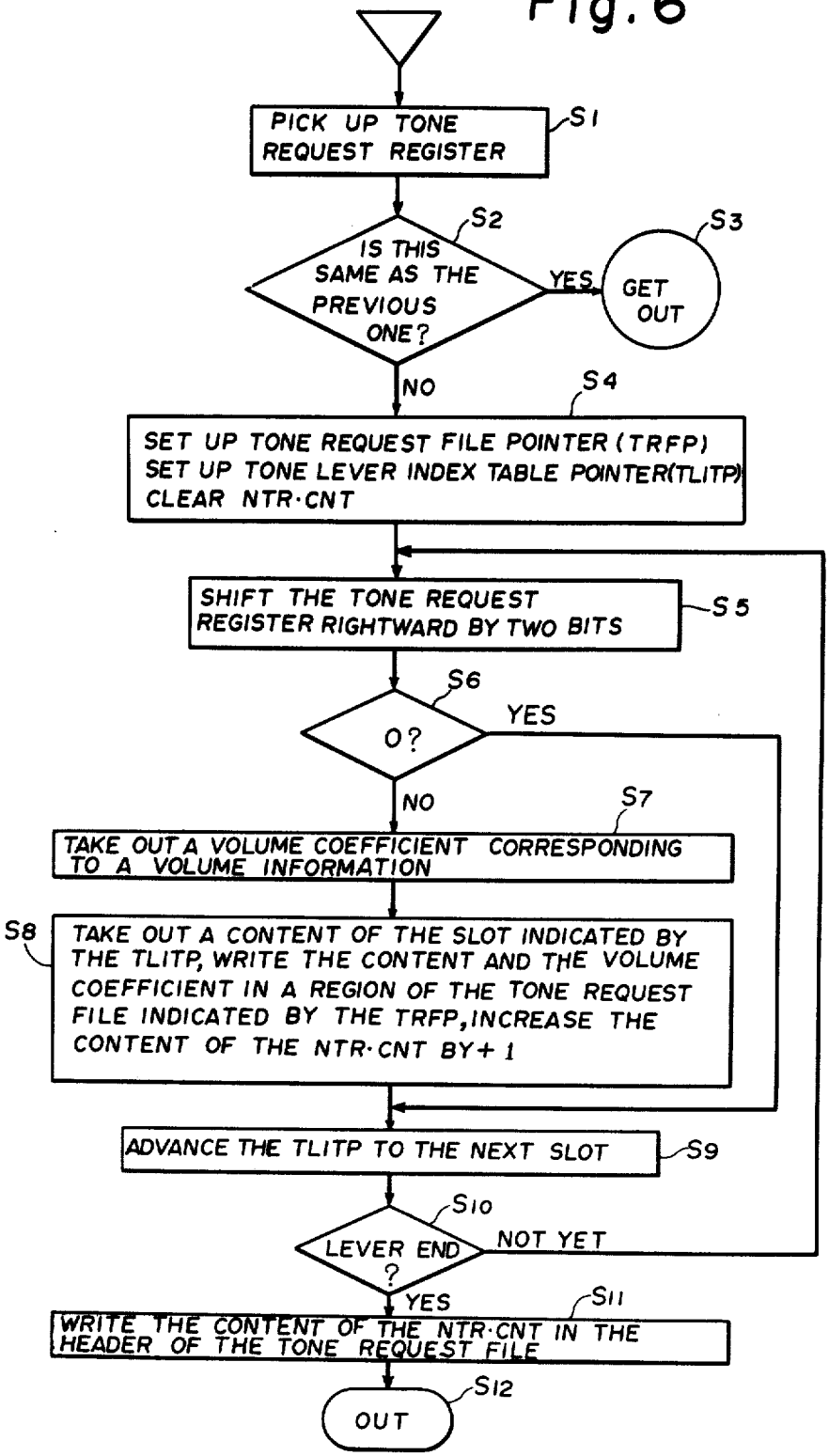
Figure 7:
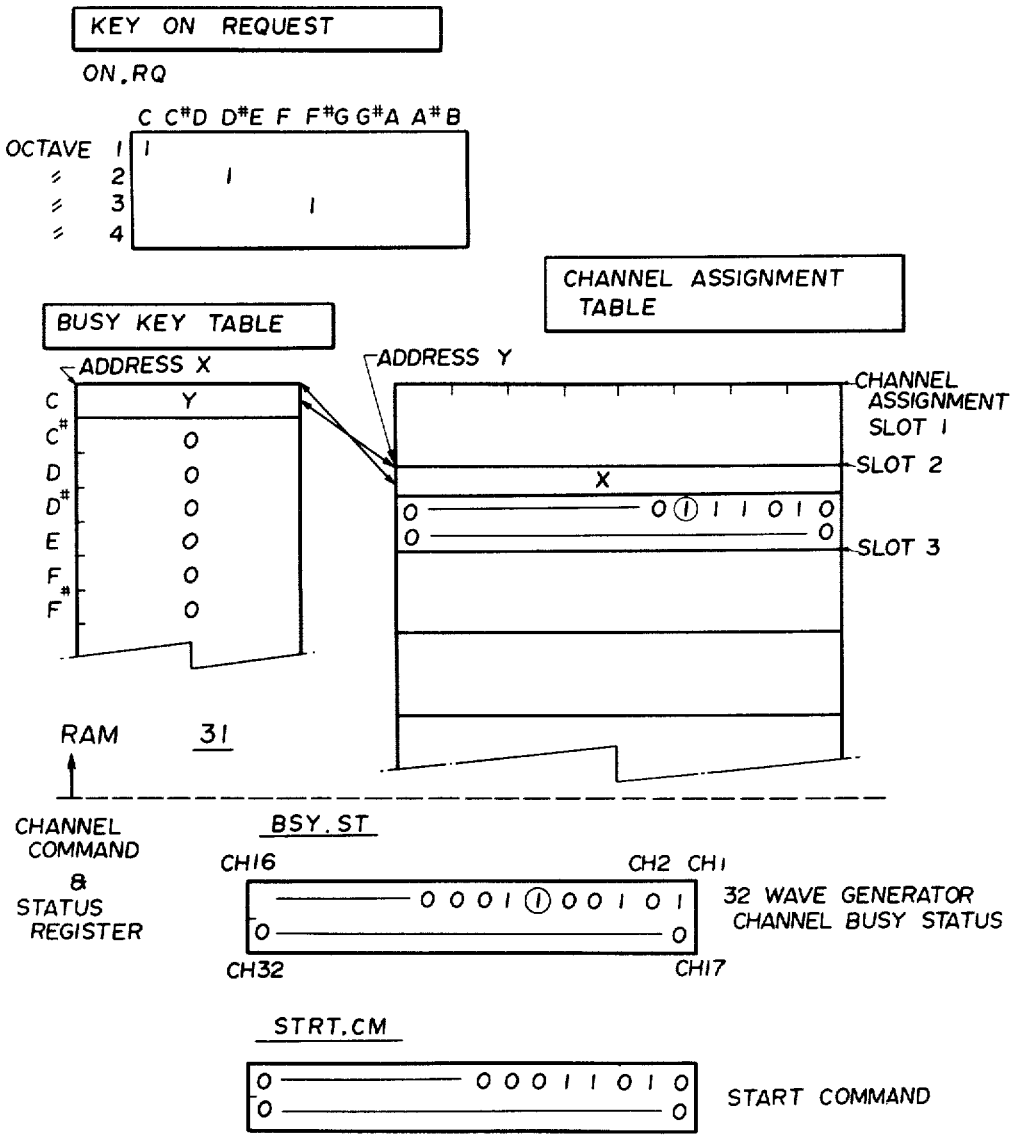
Figure 8:
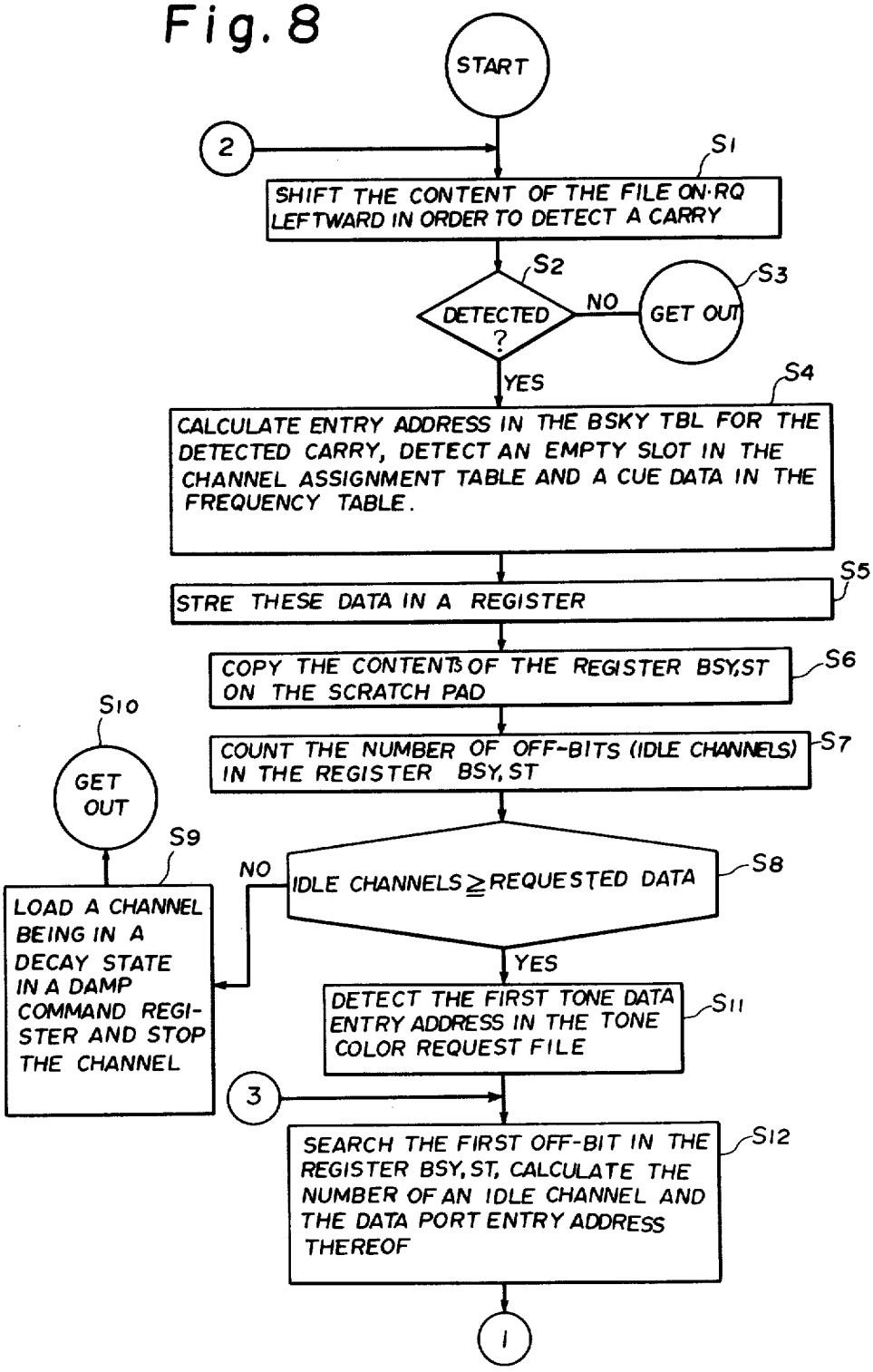
Figure 9:
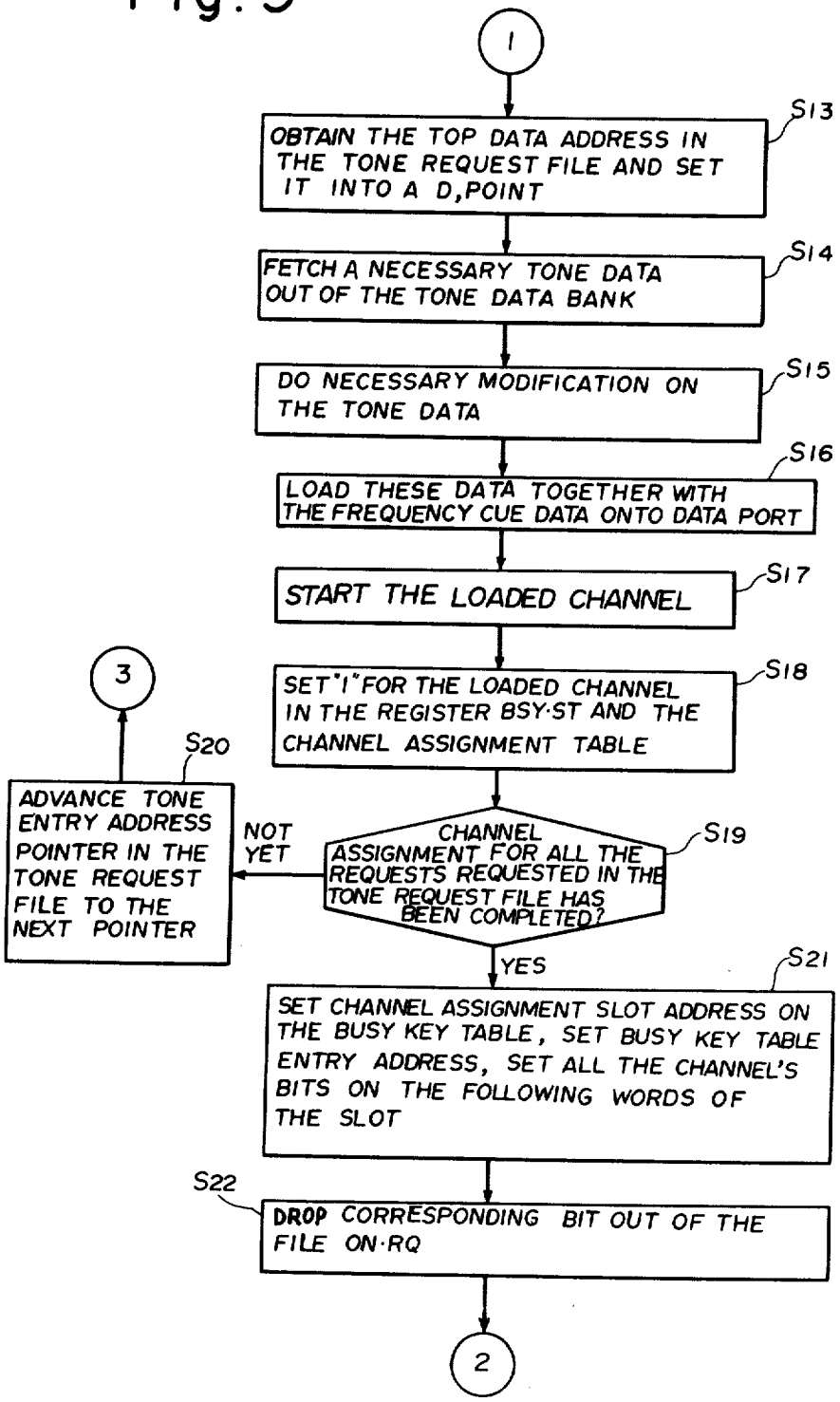
Figure 10:
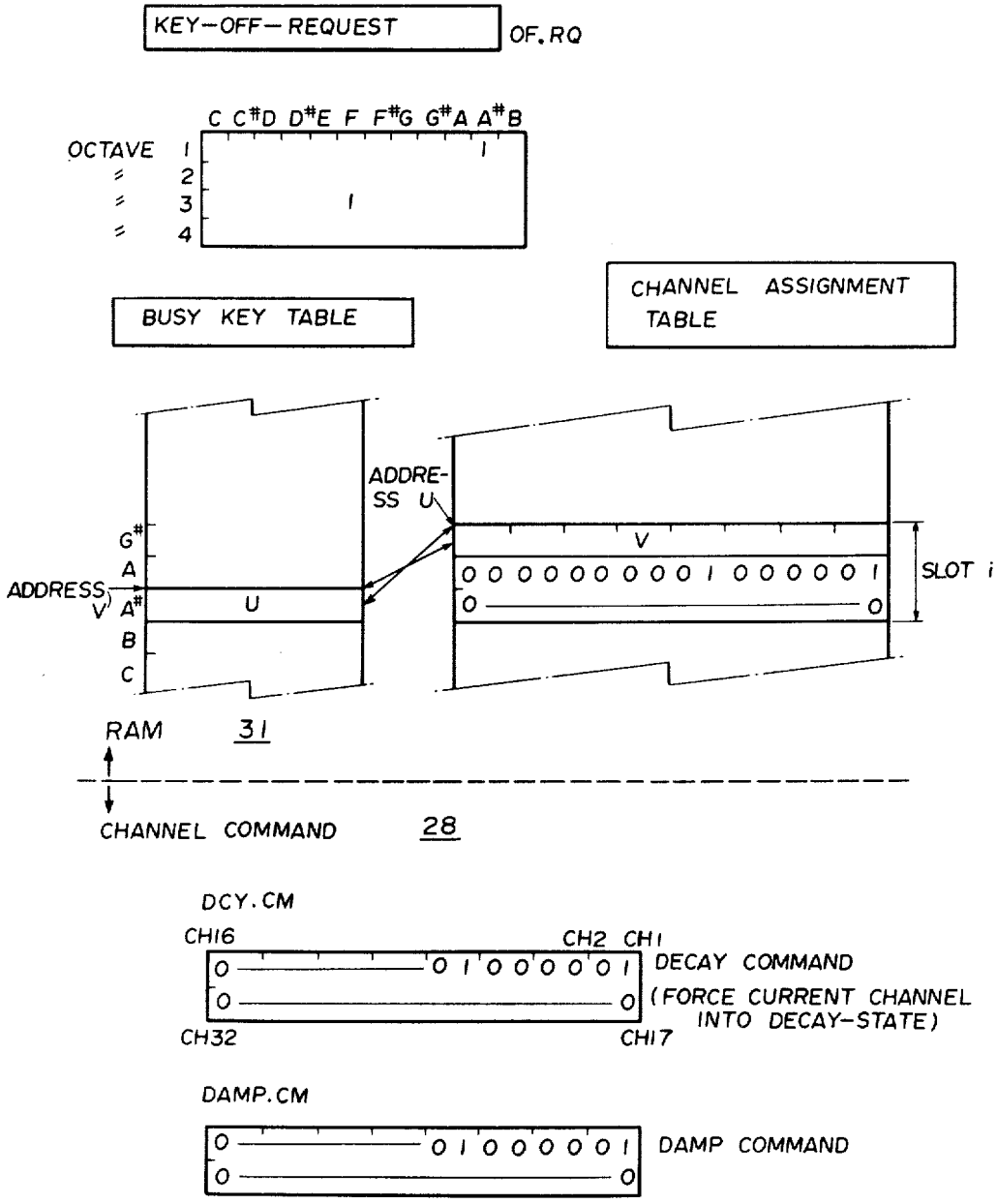
Figure 11:
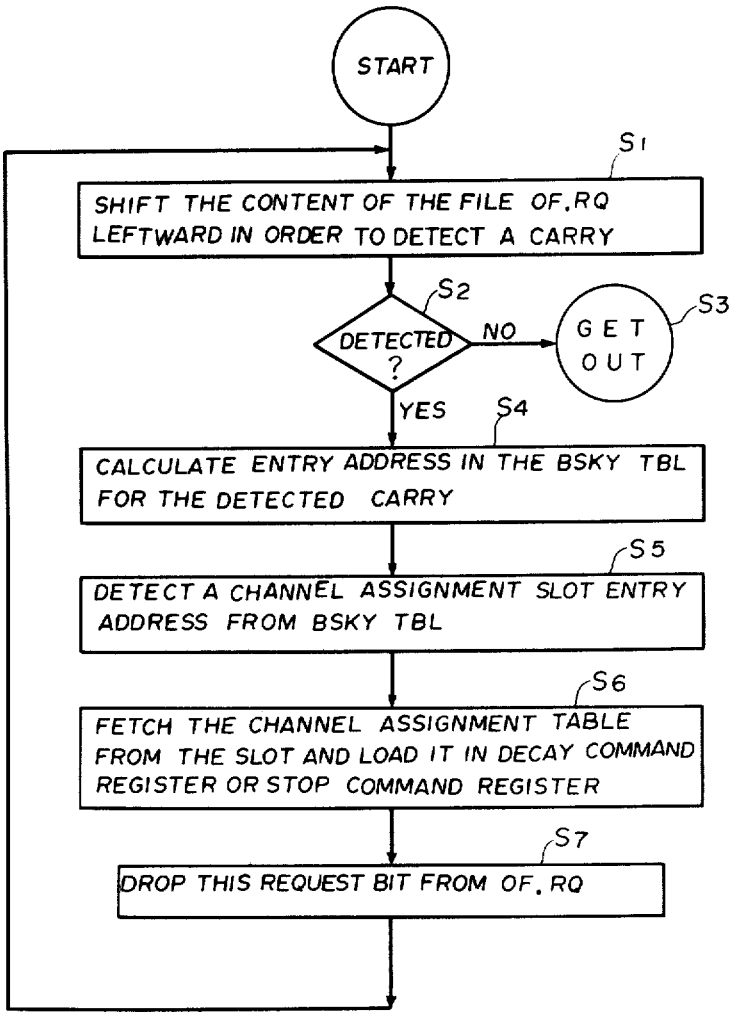
Figure 12:
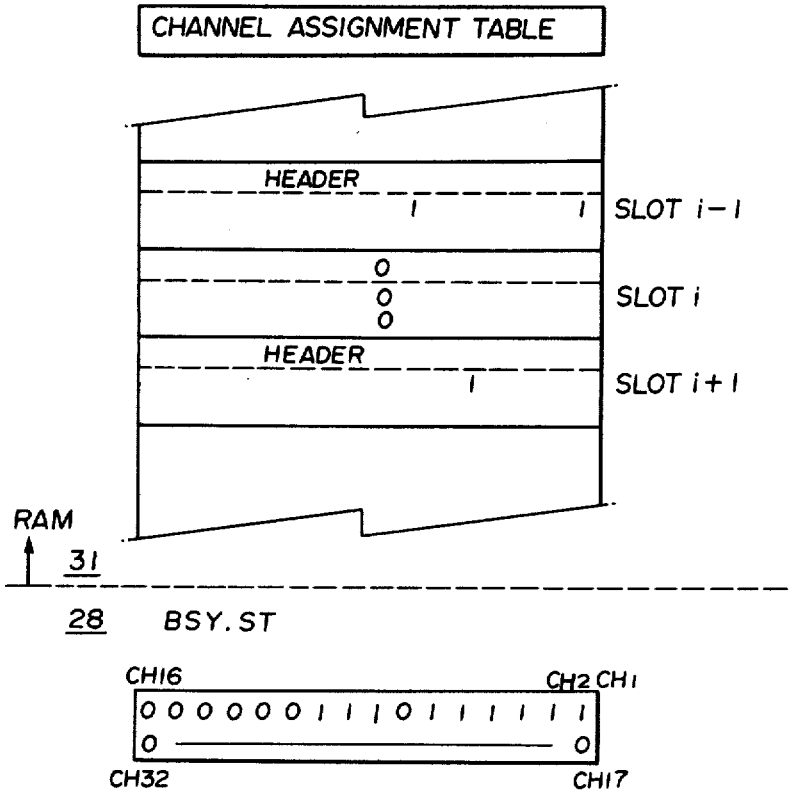
Figure 13:
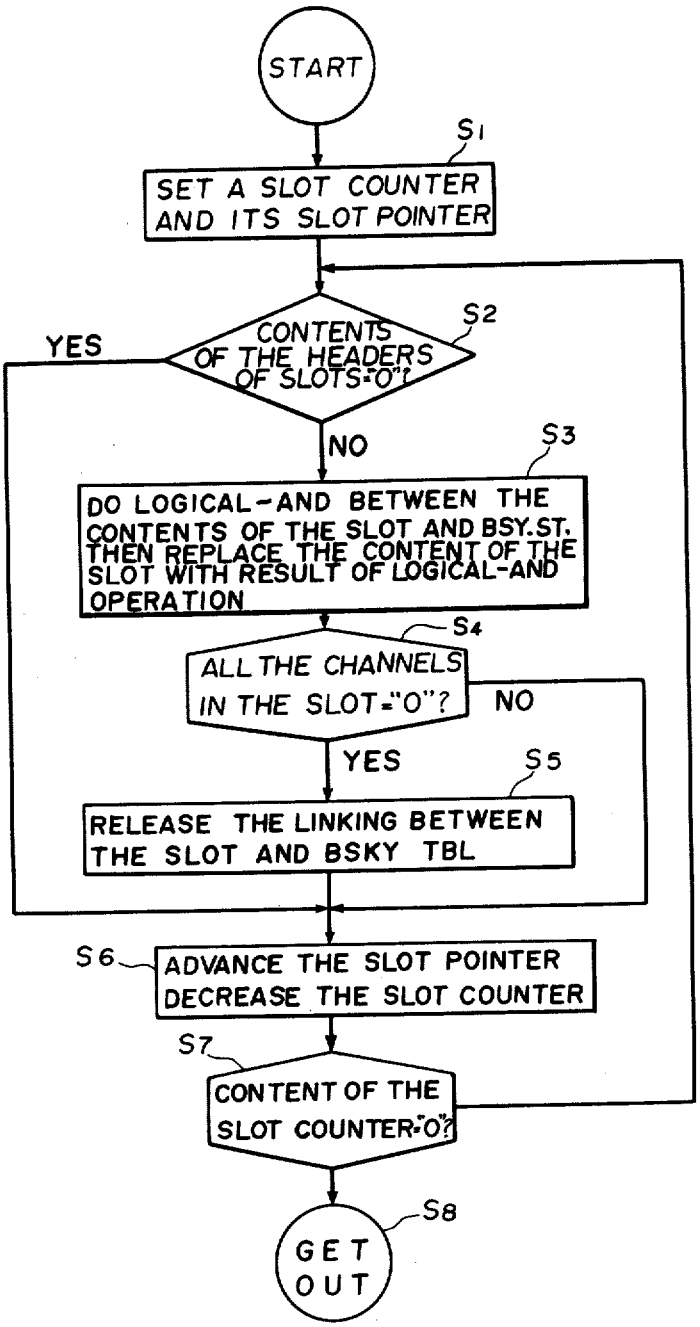
Figure 14:
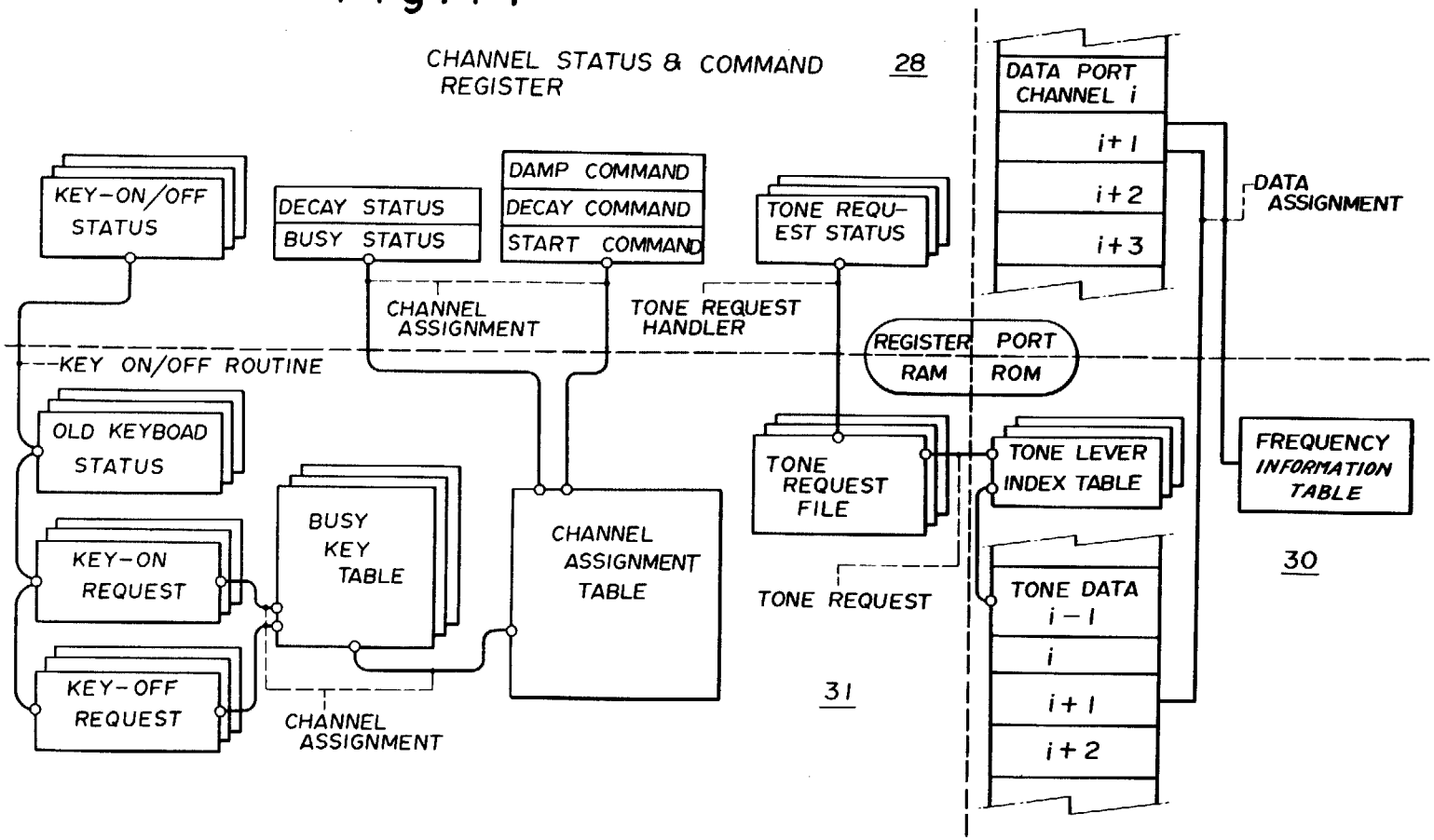

More specifically,

FIG. 2 is a block diagram showing the whole arrangement of the example;

FIG. 3 is an explanatory diagram showing the arrangement of a program module in the example;

FIG. 4 is a diagram illustrating states of a register and a random access memory (RAM) in the on-off detection of a key in the keyboard;

FIG. 5 is a diagram showing states of storages in a register, a read only memory (ROM) and the RAM in detecting a tone lever request;

FIG. 6 is a flow chart for a description of the aforementioned tone lever request detecting operation;

FIG. 7 is a diagram showing states of the RAM and register in channel assignment operation in the example;

FIG. 8 and FIG. 9 are flow charts for a description of the aforementioned channel assignment operation;

FIG. 10 is a diagram showing states of the RAM and register obtained when the channel assignment has been released in the example;

FIG. 11 is a flow chart for a description of the channel assignment releasing operation;

FIG. 12 is a diagram illustrating states of the RAM and register in channel finish interrupt operation in the example;

FIG. 13 is a flow chart for a description of the channel finish interrupt operation; and FIG. 14 is an explanatory diagram for a description of mutual relationships between various files and tables formed in the register, RAM, ROM and output port employed in the example.

DETAILED DESCRIPTION OF THE INVENTION

Referring to the accompanying drawings, one example of an electronic organ to which an assigner for an electronic musical instrument (hereinafter referred to as "an electronic musical instrument assigner" when applicable) will be described in detail.

FIG. 2 is a block diagram illustrating the whole arrangement of the aforementioned example schematically. In FIG. 2, a keyboard 10 comprises the upper and lower keyboards each having, for instance, 61 keys, and the pedal keyboard having 32 keys, with associated key switches, tone levers, and circuit connections. The on-off operation information of each key is detected by a keyboard or key switch matrix 11, an address decoder 12 and a buffer bus driver 13. More specifically, the output signal of a key address counter (not shown) adapted to count clock pulses which are continuously outputted by a pulse generator (not shown) is applied from the address bus to an input line (vertical line) of the keyboard matrix 11 through the address decoder 12. Upon depression of a key, a key output signal is provided on an output line (horizontal line) of the keyboard matrix 11, which line corresponds to the key thus depressed. This key output signal is introduced to a random access memory (RAM) 31 via the buffer bus driver 13 and data bus 35 and is stored in the random access memory 31.

Microinstruction generating section 14 includes a microprogram memory (1024 W×32 bit) 18, an instruction register 15, an instruction decoder 16, a microprogram address sequencer 17, and a pipeline register 19. Programs are stored in the microprogram memory 18 for detecting the key-on and key-off states of the keys of the keyboard 10, including the operation signals of tone levers; and for allowing an arithmetic section 20 described later to carry out various calculations for modifying various input data into tone color data when the aforementioned key-on signal is detected. Programs are also stored therein for searching for a loadable channel in an output port connected to a wave generator (not shown) so as to deliver the tone color data obtained thereto, and for introducing the data to an output port (not shown) to start an arithmetic operation for generating a musical tone in a corresponding channel in the wave generator, thereby to cause the wave generator to carry out an operation for forming a musical tone waveform. Further programs are stored therein for suspending the operation for the above-described channel in the wave generator when the key-off condition is detected and releasing the request on this channel to be ready for the detection of the next key-on signal. Whenever a microinstruction is outputted by the microprogram memory 18, a signal for designating the next address in the microprogram memory 18 is provided by the microprogram address sequencer 17 so that the programs are sequentially advanced. As mentioned above, the microprogram memory 18 stores detailed process steps concerning the operation of the arithmetic section 20 according to the respective microinstructions from ROM 30. The macroinstructions (instructions of high level in the hierarchical structure) from the ROM 30 are, for example, "Detect the on-off states of keys", "Operate for the data of the musical tone color", "Search an idle channel and allot the produced musical tone thereinto", or "Release the channel at the end of the decay of the produced tone." Against each instruction the instruction decoder 16 generates a decoded address, and a series of addresses starting from this produced decoded address are sequentially delivered by the sequencer 17, in order to sequentially generate microinstructions (instructions of low level in the hierarchical structure) from the accessed addresses of the microprogram memory. The arithmetic section 20 is operated according to the thus generated microinstructions. It is usual in the computer art to form the hierarchical structure with the instructions. As is apparent from the above description, in the arithmetic section 20, when the key-on signal is detected the tone color data corresponding to this key is modified according to the microinstruction outputted by the microprogram memory 18, and arithmetic operations and logical operations are carried out for channel assignment, etc. In this operation, fundamental tone data, etc. stored in a read only memory (or ROM) 30 is applied to the arithmetic section 20.

The arithmetic section 20, as shown in FIG. 2, comprises: a micro function decoder 21 adapted to decode the microinstruction to cause an arithmetic and logical unit (or ALU) 26 to perform a predetermined operation; a memory address register 24, a data register 25 and output buffers 22 and 23 all of which are provided on the output side of the arithmetic and logical unit 26; and multiplexers 27 and 29, and a register group 28 all of which are provided on the input side of the arithmetic and logical unit 26. The register group 28 is made up of registers for temporarily storing intermediate results of operation of the arithmetic and logical unit 26, a register for indicating a channel which is in busy state (used) and a channel which is in idle state (not used) out of the above-described plural channels, a register for indicating a channel in decay state, a register for indicating a channel in the output data port to which the tone color data is being transferred, and a register for indicating a channel which is to be started or stopped.

The above-described ROM includes, as shown in FIG. 14, the aforementioned tone data (which includes a plurality of fundamental data necessary for production of musical tones as described later in detail), a tone lever index table (indicating tone colors requested for musical tones to be produced), and a frequency information table (indicating the frequencies of musical tones to be produced).

The above-described RAM is a memory for filing scratch pads for the operation of the unit 26, the key on and off requests, and the channel assignments.

Interrupt control logic 32 is a logical circuit and is driven by pulse generator 33 generating timing clock pulses at a predetermined period, thereby to control a variety of interruption operations described later.

As is apparent from FIG. 2, in the assigner according to this invention, the keyboard 10, the micro instruction generating section 14, the arithmetic section 20, the ROM 30, the RAM 31, and the interrupt control logic 32 are independently coupled to one another via an address bus 34 and a data bus 35 through which various data are applied to the different circuits. The assigner is connected to the wave generator by way of the output port and the buses 34 and 35. The assigner and the wave generator are operated in asynchronization with each other. The above-described elements 14 and 20 will be referred to as "a micro processor" hereinafter, when applicable.

FIG. 3 illustrates the arrangement of a main program module in the above-described assigner. The loop at the left in FIG. 3 is a main routine, while the right hand side of this figure shows an interrupt routine. In the main routine, only the process necessary for channel assignment with respect to the key-on and key-off is carried out. On the other hand, in the interrupt routine, variations in performance are detected by three kinds of interruption handling so as to be interrupted in the processing operation of the main routine.

The relations between the operation of the above-described module and the data group necessary for this operation will now be described in detail.

(1) Detection of key-on and key-off operations in the keyboard 10:

In this example, interruption is repeatedly effected at time intervals of several milliseconds for detecting key-on and key-off operations. In this interrupt routine, the status of the keyboard 10 at an interruption time instant is compared with that of the keyboard 10 (hereinafter referred to as "a keyboard status" when applicable) detected and stored in RAM 31 at the immediately preceding interruption time instant, so that the files of a key-on request and a key-off request are formed in the RAM 31.

The above-described operation will be concretely described with reference to FIG. 4, in which, for simplification in description, the keyboard 10 has keys for four octaves, and the status indicated is for four octaves.

If the current keyboard status stored in the register adapted to indicate a key on request is designated by NKS, and the keyboard status which is earlier by one interruption cycle and is stored in the RAM is designated by OKS, and if the key-on request file and key-off request file formed through the comparison of NKS with OKS are designated by ON.RQ and OF.RQ, respectively, then these ON.RQ and OF.RQ can be obtained from the following Equations (1) and (2), respectively:

$$\text{ON.RQ} = \text{ON.RQ} \cup \{\text{NKS} \cap (\text{OKS} \oplus \text{NKS})\} \quad (1)$$

$$\text{OF.RQ} = \text{OF.RQ} \cup \{\text{NKS} \cap (\text{OKS} \oplus \text{NKS})\} \quad (2)$$

where $\cup$ is the logical OR, $\cap$ is the logical AND, and $\oplus$ is the logical exclusive OR.

The ON.RQ and OF.RQ are stored in the RAM 31. In each status in FIG. 4, the numeral "1" is a "1" signal in binary logical level, and the blank indicates a "0" signal in binary logical level.

In the above Equations (1) and (2), ON.RQ and OF.RQ are in logical OR relation with ON.RQ and OF.RQ which are earlier by one interruption cycle, respectively. This is to hold the request of a key not processed yet. A bit for note C in octave 1 in the key-on request status ON.RQ is "1" encircled. This means that this note is of the request on the key not processed yet. The note C in octave 1 in the status OKS is renewed after the request on the note is processed.

(2) Detection of Tone Lever Request

The tone lever can control volume in four steps: i.e., volumes 0, 1, 2 and 3. As the status of the tone lever request (indicating control of a tone lever or key by which a request is effected) is not as frequently changed as the keyboard status, interruption is effected at intervals slower than the interruption cycle for the keyboard status. FIG. 5 is a diagram for a description of this operation, comprising a request status diagram of tone levers the data of which are stored in a register 28, status diagrams of a volume table, a tone lever index table and a tone data bank which are stored in the ROM 30, a status diagram of a tone request file formed in the RAM 31.

In the tone lever register in FIG. 5, the request conditions of six tone levers for the upper keyboard, each having four steps as was described above, are stored as 2-bit information. Therefore, at the current performance no request is made for the tone lever 1 whose two bits are "00"; however, the request of volume 3 is applied to the tone lever 2, while the request of volume 2 is applied to the tone lever 3.

Factors representative of the levels (volumes) 1 through 3 obtained by the aforementioned tone levers are stored, as 7-bit information, in the volume table in the ROM 30. Indexes for the tone levers 1 through 6 are provided in the tone lever index table. As shown in FIG. 5, a plurality of slots (two slots in the example) are provided in the index of each tone lever. For instance, in the case of the tone lever 1, address pointers, i.e., a tone i pointer and a tone i-1 pointer are stored in the two slots, respectively. The tone i pointer indicates that the slot where the tone i pointer is stored corresponds to a tone data i stored in an address B in a tone data bank described later. Similarly, the tone i-1 pointer indicates that the slot where the tone i-1 pointer is stored corresponds to a tone data i-1 stored in an address A in the tone data bank of the ROM. Thus, the slots in the indexes given by the tone lever index table correspond respectively to the tone data stored in the addresses in the tone data bank indicated by the address pointers in the slots. In the above-described example, the number of slots per index is two; however, it is optional. In addition, the tone data stored in the tone data bank can be made to have lengths as desired when they are stored in the ROM 30.

If pieces of information on the tone levers are stored in the tables of the ROM 30 as described above, the data on the tone lever requested during the performance are stored in the tone request register. Therefore, at the time of an interruption routine for the tone lever request, which is repeated at a predetermined cyclical rate, a variety of information are read out of the tables in the ROM 30 according to the information in the above-described tone request register, thereby to form a tone request file in the RAM 31.

Reference characters F1-F5 represent the respective regions of the tone request file. "Vibrato frequency" and "vibrato depth" are the data for determining the frequency and the depth of vibrato when applying the vibrato effect to the generated musical tones. "Decay length" is the data for setting the decay time of the musical tones and is used in the wave generator. These data are set by the player by operating a lever just as in the case of the "tone lever."

The operation of forming the tone request file will be described with reference to a flow chart shown in FIG. 6.

In the interruption routine for detecting the tone lever request as shown in FIG. 6, first the content of the tone request register (FIG. 5) is taken out (Step $S_1$). If the content of the tone request register is coincident with the content obtained at the preceding interruption and hence stored in the tone request file, the operation is advanced to Step $S_3$ where the previous tone request file is used without change. If different, the operation is advanced to Step $S_4$, where a tone request file pointer (or TRFP) is provided, a tone lever index table pointer (or TLITP) is provided, and the content of a tone request counter (or NTR, CNT) adapted to count the number of tone data is cleared to "0". Then, in Step $S_5$, the content of the tone request register is shifted rightward by two bits. In the example of FIG. 5, the tone lever 1 whose data is stored in the least significant bit of the tone request register is not requested, and its content (volume information) is "0". Therefore, the operation is advanced to Step $S_9$ through Step $S_6$, where the TLITP is advanced to the slot of the tone lever 2, but the operation is returned to Step $S_5$ through Step $S_{10}$ because the lever is not at the end.

When the content of the tone request register is further shifted rightward by two bits, the request of the tone lever 2 is detected, and in Step $S_7$ a volume coefficient "1111111" corresponding to the volume information 3 is taken out of the volume table. Then, the operation is advanced to Step $S_8$ where the content of the slot indicated by the TLITP, that is, a tone i+2 pointer is taken out of the tone lever index table. Since this tone i+2 pointer corresponds to an address D in the tone data bank, the address D and the volume coefficient "1111111" taken out before are written as the top address of tone data actually necessary in a region (entry address) $F_3$ indicated by the TRFP. Simultaneously, the content of the tone request counter becomes "1" by addition of +1. In the case of the tone lever 2, only one pointer is in the slot of the tone lever index. Therefore, the operation in Step $S_8$ described above is carried out only once, and the operation is advanced to Step $S_9$ where the TLITP is advanced to the slot of the tone lever 3, but it is returned to Step $S_5$ through Step $S_{10}$ because the lever is not at the end. In the case of the tone lever 3 also, the operations completely simlar to those described above are carried out through Steps $S_5 \rightarrow S_6 \rightarrow S_7 \rightarrow S_8 \rightarrow S_9 \rightarrow S_{10} \rightarrow S_5$, as a result of which tone data are written in regions $F_4$ and $F_5$ of the tone request file. Upon completion of operation of the tone lever 3, the content of the aforementioned tone request counter (or NTR.CNT) becomes "3".

The tone levers 4 through 6 have the same volume information "0". Therefore, for these tone levers the operations similar to those for the tone lever 1 are repeated. Finally, upon completion of operation of the tone lever 6, the operation is advanced to Step $S_{11}$ through Step $S_{10}$, where the content "3" of the tone request counter is written in the header (or region $F_1$) of the tone request file, whereby the fact that three tone data are on request is stored.

If other information for tone coloring in common with the tone request file, such as data on a vibrato frequency, a vibrato depth, a decay length, etc. is requested from other registers similar to the tone request register, the information can be likewise written in the region $F_2$ of the tone request file.

Thus, the address of a number of tone data have been registered in the tone request file. Therefore, when a key in the keyboard 10 is depressed, the tone data corresponding to the above-described addresses are called simultaneously out of the ROM 30, and musical tones are formed with the aid of these tone data, respectively, as a result of which musical tones having plural tone colors are suitably mixed and produced. It goes without saying that whenever a different tone lever or different tone levers are requested during the performance, the tone request file is renewed. In this system, the tone levers and the tone data are coupled to one another in correspondence only to the contents of the tone lever index table. Therefore, optical tone color (tone data) assignment can be effected for the tone levers by changing the contents of the tone lever index table. In other words, this system is advantageous in that the tone color assignment of the tone levers can be changed as desired by changing the data contents are stored in the ROM 30 (FIG. 5).

(3) Channel Assignment by Key-on Detection

In this channel assignment, as was described in paragraph (1) "Detection of Key-on and Key-off Operations", the key-on request file ON.RQ formed in the RAM 31 is utilized so as to assign channels to a plurality of tone data requested by depression of a key. The channel assignment will be described with reference to FIGS. 7 to 9.

In an example shown in FIG. 7, the file ON.RQ stored in the RAM 31 is simplified for convenience in description, that is, the file is for only four octaves. As is apparent from FIG. 7, the key for note C in octave 1, for note D# in octave 2, and for note F# in octave 3 are being operated, and carry detection is effected by shifting the bits leftward one by one successively starting from octave 1 in the file ON.RQ. Accordingly, upon detection of the carry, the tone pitch of a key being operated can be determined from the carry detection position (or the detection timing).

In this operation, a busy key table formed in the RAM 31 is utilized. The storage capacity of the busy key table is equal to the number of keys, the table indicating that when an area (address) corresponding to a key is at a level "1" (on bit) the key is being operated and that when it is at a level "0" (off bit), the key is not operated.

Furthermore, in this operation, a channel assignment table formed simultaneously in the RAM 31 is utilized. This table has a plurality of addresses (areas) in a correspondence relation of 1:1 to keys being operated. In the example thereof shown in FIG. 7, each address has a slot having a capacity of three words (each word consisting of 16 bits). One word in the slot is employed as the header, in which an entry address of the busy key table (in the example, an entry address X assigned to the Key C in octave 1) is written. The remaining words in the slot are in correspondence to 32 channels (that is, one bit per channel). As for channels whose bits are on-bits out of the channels, it is indicated that in the example shown the key for note C in octave 1 has been assigned to these on-bit channels. Furthermore, the entry address (or an address Y) of the slot of the channel assignment table is employed as the address in the busy key table for the key of note C in octave 1, and the busy key table and the channel assignment table for the key of note C in octave 1 are in correspondence with each other.

The above-described channel assignment operation will now be further described with reference to a channel busy status register (or BSY.ST) and a start command register (or STRT.CM) shown in FIG. 7, and to flow charts shown in FIGS. 8 and 9. In the example shown in FIG. 7, the register BSY.ST indicates that channels 1, 3, 6 and 7 are being used.

First, in Step $S_1$ carry detection is effected by shifting the content of the file ON.RQ leftward successively starting from octave 1. In this example, the on-bit is stored for note C in octave 1, and therefore the carry due to this on-bit is detected first. Accordingly, the operation is advanced to Step $S_4$ through Step $S_2$. In Step $S_4$, an arithmetic operation for detecting the entry address in the busy key table BSKY TBL for the note (C in octave 1) detected is carried out, while an arithmetic operation for detecting an empty slot (which is not in use) in the channel assignment table for this note is also carried out, whereby the first detected empty slot is employed for the note. Furthermore, cue data for setting a frequency for this note is taken out of the frequency table in the ROM 30. As a result of the aforementioned operation, the address of the note (C in channel 1) in the busy key table is determined as X, while the address of the note in the channel assignment table is determined as Y. These data thus determined are temporarily stored in a memory register, in Step $S_5$. Then, in Step $S_6$, the contents of the register BSY.ST indicating the status of use of 32 channels are copied on the scratch pad as they are, thereby to count the number of off-bits in the register, i.e., the number of idle (not in use) channels. The status of the register BSY.ST is such that, as described before, the channels 1, 3, 6 and 7 are in use, or busy, immediately before the assignment of the note (C in octave 1). Therefore, it is necessary to assign the note to channels other than the above-described channels. In order to prevent duplication in assignment, more specifically, in order to prevent assignment of a plurality of data to one idle channel during the assignment operation, first in Step $S_6$ the contents of the register BSY.ST are copied on the scratch pad as they are, and then in Step $S_7$ the number of off-bits are counted, as described above. As a result, 28 channels obtained by subtracting the number of busy channels (4 channels) from 32 channels are provided as idle channels. Then, the number (28) of idle channels described above is compared with the number (3) of all tone color data requests registered in the tone request file at present (FIG. 5) in Step $S_8$. In this case, as the number of idle channels is larger, the operation is advanced to a channel assignment routine in Step $S_{11}$ and so forth, where the following operations are effected for three data entered in the tone color request file shown in FIG. 5. First in Step $S_{11}$, the first tone data entry address $F_3$ in the tone color request file is detected, and then in Step $S_{12}$ the first encountering off-bit in the register BSY.ST the contents of which have been copied is searched so that the number of the channel is calculated. In this example, channel 2 is assigned from the register BSY.ST. Then, the data port entry address (for instance $A_2$) for this channel 2 is calculated. Then, in Step $S_{13}$ the top data address in the tone request file is obtained according to the D pointer and is set into a data pointer (D.PNT). In Step $S_{14}$, necessary tone data i+2 is fetched out of the tone data bank according to the above-described data pointer, and is subjected to necessary modification (the detailed description of which is omitted). Next, these data together with the frequency cue data are delivered to the previously calculated data port entry address in the data port. The bit of channel 2 of the start command register STRT.CM is changed to "1" thereby to start the arithmetic operation of channel 2. As a result, the assignment of channel 2 is completed, and channel 2 is in a busy state. Therefore, the bit of channel 2 of the register BSY.ST will be "1". Similarly as in this case, the bit of channel 2 in slot 2 of the channel assignment table will be "1".

Now, in Step $S_{19}$, it is determined whether or not channel assignment for all the requests (three requests in this case) requested in the tone request file has been completed. However, since two requests are still left, the operation is returned to Step $S_{12}$ through $S_{20}$, and the operations in Steps $S_{12}$ through $S_{18}$ are repeated also for the tone data entry addresses $F_4$ and $F_5$ in the tone request file. As a result, channels 4 and 5 are assigned to the requests of the entry addresses $F_4$ and $F_5$, respectively. Accordingly, the bits of channels 4 and 5 in the start command register STRT.CM will be "1", and similarly the bits of channels 4 and 5 in the register BSY.ST will have "1".

In the above description, the assigned channels 2, 4 and 5 are started at different time instants. However, if these channels 2, 4 and 5 are started simultaneously when assignment of the channels 2, 4 and 5 has been completed, it can save time and is economical.

Therefore, after channel assignment for three tone data requested in the tone request file has been completed, the operation is advanced to the next Step $S_{21}$, where the address Y is written in the channel assignment slot address of the slot for the above-described note (C in octave 1) on the busy key table, while the address X is written in the header of slot 2 in the channel assignment table so that both addresses are coupled to each other, and in addition the bits of channels 2, 4 and 5 are raised to "1" or on-bits. Thus, channel assignment of the note (C in octave 1) has been completed. Then, in Step $S_{22}$, the request for the note C in octave 1 is dropped out of the file ONRQ so as to be off-bit.

As shown in FIG. 7, channel 6 of slot 2 in the channel assignment table has an on-bit (encircled). This indicates that this channel 6 is not a channel assigned by this channel assignment operation; however, the same key (that is, note C in octave 1) as that this time was depressed and released but its tone is still being decayed and therefore the channel 6 is still in a busy state. Accordingly, in this example, in the case where the channel assignment table is coupled to the busy key table as was described above, taking into consideration the case of the channel 6 in such state as described above the content of the start command register for this channel 6 and the content of the register STRT CM obtained by the present assignment operation are subjected to logical OR operation.

In this example, when it is detected in Step $S_8$ that the number of off-bits in the register BSY.ST is less than the number of tone data requests in the tone request file, the channel assignment is not achieved. Therefore, the operation is advanced to Step $S_9$. In this case, out of the busy channels in the register BST.ST a channel which has been in a decay state is detected from a decay command register DCY.CM (FIG. 10) described later and is loaded in a damp command register for this channel, whereby the channel is forced to an idle state so as to quickly effect channel assignment of the key being depressed at present.

Upon completion of the channel assignment for note C in octave 1 as described above, the on-bit of this note is dropped out of the file ON.RQ and then the operation is returned to Step $S_1$ so that channel assignment is similarly carried out for the next note, i.e., note D# in octave 2. The same operation is carried out for note F# in octave 3 also. Thus, the tone color data in the channels assigned for the notes and loaded in the output port are simultaneously delivered to the respective channels in the wave generator from the output port, as a result of which a plurality of tones are produced by operation of one key.

(4) Channel Release by Key-off Detection

The operation in which when a key-off operation is detected the channel assigned to this key is released, will be described with reference to FIGS. 10 and 11.

This operation employs a key-off request file OF.RQ, a busy key table, a channel assignment table (these are formed in the RAM 31), and both channel command registers, which are a decay command register DCY.CM and a damp command register DAMP.CM, all of which are formed in the RAM 31. In FIG. 10, the file OF. RQ is simplified for convenience in description, that is, the file is for only four octaves. As is apparent from FIG. 10, the key-off operations of note A# in octave 1 and note F in octave 3 are requested. It is assumed that in the busy key table, the note A# in octave 1 is filed in an entry address V, and is entered in a slot i of a slot entry address U in the channel assignment table. Accordingly, the entry address V of the busy key table is written in the header of the slot i in the channel assignment table, and the aforementioned notes are assigned to channels 1 and 7.

The channel release operation, under the above-described conditions, will be described with reference to a flow chart shown in FIG. 11.

Upon start of this routine, first in Step $S_1$ carry detection is effected by shifting bits leftward one by one successively starting from octave 1 in the file OF.RQ. In this case, there is an on-bit for note A# in octave 1, the carry for this note A# is detected. Then, the operation is advanced to Step $S_4$ through Step $S_2$. In Step $S_4$, an arithmetic operation for calculating the entry address in the busy key table where the on-bit is entered from the detection position (or tone pitch) is carried out to obtain the address V. Then, in Step $S_5$, the entry address U in the slot of the channel assignment table corresponding to the note (A# in octave 1) is detected from the address V in the busy key table. Upon detection of the address U, the operation is further advanced to Step $S_6$, where channels 1 and 7 which have been busy are loaded, as they are, in the decay command register. Therefore, as indicated in the register DCY.CM shown in FIG. 10, channels 1 and 7 have on-bits, and the note A# in octave 1 which has been assigned to channels 1 and 7 is brought to be in a decay state. Now, in Step $S_7$, the on-bit for note A# in octave 1 in the file OF.RQ is changed to an off-bit, the note is dropped out of the file OF.RQ. Then, the operation is returned to Step $S_1$, where the same channel release operation is carried out for the following note, or note F in octave 3, which is on key-off request. Therefore, the channel release operation for the note F will not be described.

When it is required to instantly stop a tone production in the channel release operation, the content of the slot i is loaded in the register DAMP.CM instead of the register DCY.CM, as a result of which the channel to which the tone has been assigned is released immediately.

Even if the coupling of the busy key table and the channel assignment table is released immediately upon completion of the channel release operation, no trouble is caused; however, it is advisable to release the coupling at the time of a channel finish interrupt operation described below.

(5) Channel Finish Interrupt Operation

This operation is to more effectively carry out the assignment of one key to a number of channels, one of the specific features of this invention.

As is apparent from the above description, when a key is operated, a plurality of tone data concerning this key are assigned to a plurality of channels. The contents of the plural tone data are different from one another. Therefore, even if the key is in an "on" state or it is being operated, a channel to which a percussive tone data is assigned will be finished earlier. Accordingly, the channels are different in finish timing from one another, and therefore channels which have finished earlier are maintained idle until the key is released. Thus, if these idle channels are utilized as channels for producing other musical tones, the channels whose number is limited can be most effectively used.

In the case where the idle channel is employed as a channel for another tone (key) as was described above, the other key is assigned to the register BSY.ST of the initially depressed key. And when the initially depressed key is released, as was described before the content of the slot of the channel assignment table is loaded, for instance, in the decay command register, so that all the channels registered in the slot are eliminated. As a result, the data of the other key assigned to the relevant channel is also eliminated. Therefore, it is necessary to renew this channel.

In this invention, instead of the above-described channel renewal, when a channel for a key is finished, a channel finish interrupt routine is started. In this routine, the current content of the register BSY.ST and the contents of all the slots in the channel assignment table are subjected to logical AND operation so as to eliminate the above-described finished channel from the relevant slot, thereby to assign this channel to the other key.

This operation will be described with reference to FIGS. 12 and 13. With the example shown, it is assumed that as channel 7 assigned to the key of slot i-l has been finished, the channel 7 is going to be eliminated from slot i-l.

With this routine, first in Step $S_1$ a slot counter for specifying the addresses of slots in the channel assignment table, and its slot pointer are set. Then, in Step $S_2$ it is decided whether or not the contents of the headers of slots are "O" starting from the top slot in the channel assignment table. If the content of the header is "0", the slot is used for none of the keys. Therefore, the operation is advanced to Step $S_6$, where the slot pointer is advanced to the next slot, and the content of the slot counter is decreased in correspondence thereto. Then, in Step 7 it is decided whether or not the content of the slot counter is "0". In this case, the contents of all of the slots are not detected yet, and therefore the content of the slot counter is not "0". Hence, the operation is returned to Step $S_2$. Upon arrival at slot i-l, this slot i-l is being used, and the entry address of the relevant key is written in the header thereof, and therefore its content is not "0". Accordingly, the operation is advanced to Step $S_3$, where the content of slot i-l (channels 1 and 7 having on-bits) and the content of the register BSY.ST at present are subjected to logical AND operation. In this case, as channel 7 of the register BSY.ST has had an off-bit already, the result of logical AND operation with respect to channel 7 is "0", while the result of logical AND operation with respect to channel 1 is "1". Accordingly, an on-bit is written in channel 1 of slot i-l again, while an off-bit is written in channel 7 as a result of which channel 7 is finished in slot i-l so as to be assigned to another key. Next, in Step $S_4$ it is determined whether or not all the channels in slot i-l have off-bits. In this case, as channel 1 still has an on-bit, the operation is advanced to Step $S_6$, where the slot pointer is advanced to i, and the content of the slot counter is reduced by one slot. Then, the operation is advanced through Step $S_7$ to Step $S_2$. Since slot i is not used, similarly the operation is returned to Step $S_2$ through Steps $S_6$ and $S_7$ to effect the operation of slot i+1. As for slot i+l, the operation is returned to Step $S_2$ similarly as in the case of slot i-l because channel 5 is used. When all the slots are detected as described above, the content of the slot counter becomes "0". This state, being detected in Step $S_7$, gets out of the routine.

If there is a slot all the channels in which have off-bits when the operation of Step $S_3$ is completed, this slot is detected in Step $S_4$, and the operation is therefore advanced to Step $S_5$, where the linking between the slot and the busy key table is released, as a result of which the header of the slot is cleared. As a result, the slot can be utilized for another key.

The essential operations of the assigner according to this invention are as described above.

The routine for the channel assignment releasing operation is illustrated in the flow chart of FIG. 11, and FIG. 12 illustrates the states of the RAM and register in the channel finish interupt operation disclosed in the example. FIG. 13 shows the routine for the channel finish interrupt operation.

FIG. 14 shows the relationships between the various tables in the ROM 30, the various files formed in the RAM 31, the various registers, and the data ports all of which have been described above. In FIG. 14, three blocks are shown as being piled one on another, to correspond to the upper key, lower key and pedal key, respectively.

In the above-described example, the assigner according to this invention is applied to an electronic organ; however, it is obvious that the assigner can be applied to electronic musical instruments other than electronic organs. Furthermore, in the above-described example, the number of channels is thirty-two (32); however, it is also obvious that the number of channels can be increased or decreased as desired. The wave generator controlled by the assigner according to this invention has not been described in detail; however, it should be noted that it may be any wave generator, for instance, an apparatus disclosed in the specification of United States patent application Ser. No. 865,272 filed on Dec. 28, 1977, now abandoned under Paris Convention claiming the priority based on Japanese Patent Application No. 51-158945 (filed on Dec. 29, 1976) under the title of "Wave Generator for Electronic Musical Instrument" and assigned to the same assignee as the present application.

As is apparent from the above description, according to this invention, the assigner for an electronic musical instrument comprises the microprocessor and the memory, and it is so designed that a plurality of tone color data requested for a key being operated by operating the tone lever or the like are assigned to a plurality of channels calculated by the microprocessor, and these channels are stored in the memory. Therefore, a plurality of tone-colored musical tones can be produced simultaneously by operating one key in the keyboard, which is very convenient in performance. Another advantage of this invention is that a plurality of tone data requested for one key can be assigned most effectively to a plurality of channels, and in addition the channel assignment can be quickly changed for key and tone data requests which vary at all times during the performance.

Furthermore, integrated circuits available on the market can be utilized as the aforementioned microprogram, arithmetic section and memory, and therefore the assigner can be manufactured at low cost and can be miniaturized. This is another advantage of this invention. In addition, the invention is advantageous in that the number of channels can be readily increased or decreased as desired.

The keyboard key output detecting device which is completely novel, being different from the conventional key coder employed in an electronic musical instrument, is, according to the invention, made up of the interruption control circuit for carrying out interruption at a predetermined cycle to the operation of keyboard's keys, a microprogram in which during the interruption process of the interruption control circuit each current keyboard status is calculated and the on-off information on the current keyboard's key is calculated by subjecting the calculated current keyboard status and the keyboard status one cycle earlier to comparison, the arithmetic section controlled by the microprogram, and the memory means for storing the above-described keyboard's key on-off information. Therefore, it is an additional advantage of the invention that the keyboard's key on-off information can be obtained by a very simple process.

What is claimed is:

1. An assigner for an electronic musical instrument having keyboard's keys and tone levers, which comprises: a microprogram section storing a microprogram; memory means storing frequency information corresponding to the respective keys and tone data corresponding to the respective tone levers and having storing positions which define tone producing channels, and an arithmetic section which is controlled by said microprogram in such a manner that the frequency information and the tone data requested for a keyboard's key being operated and the tone lever being operated are assigned to the tone producing channels specified by said arithmetic section.

2. An assigner as claimed in claim 1, in which said microprogram comprises: a program for detecting by calculation a key which is in "on" state out of keys in a keyboard to set predetermined data at positions corresponding to key arrangement thereby forming a key-on request file in said memory means; a program for indicating for every key whether or not at least one of said channels is assigned thereby forming a busy key table in said memory means; and a program for assigning a plurality of channels to keyboard's keys being operated by utilizing said key-on request file and busy key table to form a channel assignment table.

3. An assigner as claimed in claim 1, in which said microprogram is one which carries out operations in which the number of tone data being requested is compared with the number of channels being not used, and when the latter is larger than the former, channels are assigned to a new key.

4. An assigner as claimed in claim 1, in which said microprogram is one which operates to detect by calculation a key the state of which has been changed from its "on" state to its "off" state thereby cancelling channel assignment to said key.

5. An assigner as claimed in claim 1, in which said microprogram is a program in which out of channels assigned to keys, channels placed in idle state as formation of musical tones of relevant tone data has been completed before the "off" states of relevant keys are detected are assigned to other keys in "on" state.

6. An assigner as claimed in claim 2, in which said microprogram is a program in which after all channel assignments to keyboard's keys being operated have been completed and all pieces of channel information related to said channel assignments have been entered into said channel assignment table, said pieces of relevant channel information are delivered as the output of the assigner.

7. An assigner as claimed in claim 2, in which said microprogram is a program in which whenever a channel is assigned to a keyboard's key being operated and is entered into said channel assignment table, channel information related to the assignment of said channel is delivered as the output of the assigner.

8. An assigner as claimed in claim 3, in which said microprogram is a program in which when said number of tone dat is larger than said number of channel being not used, out of channels which are assigned to other keys and are being used, channels placed in decay state are detected, and said channe decay state are processed to be in non-use state and are as to new keys.

9. An assigner as claimed in claim 4, in which said microprogram is a program in which cancellation of channel assignment to a key the state of which has been shifted to key-off state can be carried out at an optional time instant after the state of said key has been shifted to key-off state.

10. An assigner as claimed in claim 9, in which said memory means comprises: a first memory for storing the keyboard status of a keyboard key in a cycle; a second memory for storing the contents of said first memory at the succeeding cycle; a third memory for storing the keyboard status of the keyboard's key being operated which is calculated by comparing the contents of the first memory with the contents of the second memory; and a fourth memory for storing the keyboard status of a keyboard's key whose state has been shifted to non-operation state from operation state, said keyboard status being calculated by comparing the contents of said first memory with the contents of said second memory.

11. An assigner for an electronic musical instrument, which is provided with keyboard's keys comprising: a micro processor, an interruption control circuit connected to control interruption cycles at a predetermined period in the operation of said keyboard's keys; a microprogram in which, during said interruption cycles of said interruption control circuit, each present keyboard status is calculated and on-off information on the present keyboard's key is calculated by comparing the calculated present keyboard status and the keyboard status one cycle earlier; said microprocessor having an arithmetic section connected to be operated by said microprogram; and memory means for storing said on-off information of said keyboard's keys.

12. An assigner for assigning tone production to an appropriate channel or channels in an electronic musical instrument having a plurality of keys and a plurality of tone controlling members for designating qualities of tones to be produced respectively, said assigner comprising:

program memory means having a program which defines sequence of processing regarding tone production assignment step by step;

data memory means connected to store first data corresponding to said plurality of keys and second data corresponding to said plurality of tone controlling members respectively;

channel memory means having memory positions which correspond to a plurality of tone production channels respectively, the number of said tone production channels being less than the number of said plurality of keys, said channel memory means having a plurality of channels, and microprocessor means coupled to said program memory means, data memory means, and channel memory means and keys and tone controlling members to read out said program and assign first data and second data corresponding to a newly depressed key and newly operated tone controlling member or members respectively among said stored first data and said second data to available one or more of said tone production channels in accordance with said program, said microprocessor means being connected to assign said first data corresponding to said newly depressed key and second data corresponding to said newly operated tone controlling member or members in such a manner that each of said second data is assigned to the available one of said tone production channels together with said first data.

13. An assigner as claimed in claim 12, where said program comprises a first program which defines sequence of processing to detect said newly depressed key step by step; and said microprocessor means is coupled to detect said newly depressed key by comparing a key or keys currently being depressed with a key or keys depressed at the preceding detection in accordance with said first program.

14. An assigner as claimed in claim 12, wherein said first data corresponding to said newly depressed key and second data corresponding to said newly operated tone controlling member or members is assigned when the number of said second data is smaller than or equal to the number of said available one or more channels among said tone production channels.

15. An assigner as claimed in claim 12, wherein said program comprises a second program which defines a sequence of processing to detect said newly operated tone controlling member or members step by step; and said microprocessor means detects said newly operated tone controlling member or members repetitively by comparing a tone controlling member or members currently operated with a tone controlling member or members operated at the preceding detection in accordance with said second program.

16. An assigner as claimed in claim 12, wherein said program comprises a third program which defines a sequence of processing to detect a newly released key or keys step by step, and newly released key or keys having been depressed just before the release of said key or keys and a fourth program which defines sequence of processing to cancel the assigned key data step by step; and said microprocessor means is connected to detect said newly released key or keys repetitively by comparing a key or keys being released now with a key or keys being released at the preceding detection in accordance with said third program to cancel the assignment of the first data corresponding to said newly released key or keys in accordance with said fourth program.

17. An assigner as claimed in claim 12, wherein said second data comprises tone color data and tone volume data designating respectively a tone color and a tone volume of a musical tone to be produced.

18. An assigner as claimed in claim 13, comprising means for interrupting the cycle of said microprocessor means at a predetermined period to start the processing corresponding to said first program so that said newly depressed key is detected in the cycle at said predetermined period.

19. An assigner for assigning a tone production to an appropriate channel or channels in an electronic musical instrument having a plurality of keys, said assigner comprising:

program memory means for storing a program which defines a sequence of processing regarding a tone production assignment step by step;

channel memory means having memory positions which correspond to tone production channels respectively, the number of said tone production channels being smaller than the number of said plurality of keys, said channel memory means having a plurality of channels; and microprocessor means coupled to said program memory means, and channel memory means and keys to read out said program and to assign data corresponding to a newly depressed key among said plurality of keys to an available one or more of said tone production channels in accordance with said program.

20. An assigner as claimed in claim 19, wherein said program comprises a first program which defines a sequence of processing to detect said newly depressed key step by step; and said microprocessor means is connected to detect said newly depressed key by comparing a key or keys currently being depressed with a key or keys depressed at the preceding detection in accordance with said first program.

21. An assigner for an electronic musical instrument having keyboard keys and tone levers, said assigner comprising a microprocessor having a microprogram, memory means having stored therein frequency data corresponding to said keys and tone data corresponding to said tone levers and having memory positions which define tone producing channels, and an arithmetic section, said keyboard, microprocessor, memory means and arithmetic section being interconnected by address and data channels, whereby the program of said microprocessor, in response to operation of said keys or tone levers, controls said arithmetic section, and said arithmetic section controls said memory means to output the corresponding frequency information and tone data respectively.

* * * * *